US011109650B2

(12) United States Patent
Martinson et al.

(10) Patent No.: US 11,109,650 B2
(45) Date of Patent: Sep. 7, 2021

(54) SYSTEMS AND METHODS FOR IMPROVED ZIPPER SLIDER GARAGE

(71) Applicant: NITE IZE, INC., Boulder, CO (US)

(72) Inventors: Daniel J. Martinson, Medina, MN (US); Kent H. Brightman, Rogers, MN (US)

(73) Assignee: NITE IZE, INC., Boulder, CO (US)

( * ) Notice: Subject to any disclaimer, the term of this patent is extended or adjusted under 35 U.S.C. 154(b) by 0 days.

(21) Appl. No.: 16/211,128

(22) Filed: Dec. 5, 2018

(65) Prior Publication Data

US 2019/0104811 A1 Apr. 11, 2019

Related U.S. Application Data

(63) Continuation-in-part of application No. 15/612,926, filed on Jun. 2, 2017, which is a continuation of (Continued)

(51) Int. Cl.

| | |
|---|---|
| ***A44B 19/16*** | (2006.01) |
| ***A44B 19/32*** | (2006.01) |
| ***A44B 19/42*** | (2006.01) |
| ***A44B 19/36*** | (2006.01) |
| *B65D 33/25* | (2006.01) |

(52) U.S. Cl.

CPC ..... *A44B 19/16* (2013.01); *A44B 19/32* (2013.01); *A44B 19/36* (2013.01); *A44B 19/42* (2013.01); *B65D 33/2591* (2013.01)

(58) Field of Classification Search

CPC ..... A44B 19/16; A44B 19/32; A44B 19/36; A44B 19/42; Y10T 24/2593

See application file for complete search history.

(56) References Cited

U.S. PATENT DOCUMENTS 2,800,699 A * 7/1957 Armstrong ..... A44B 19/36 24/387
2,923,992 A 2/1960 Armstrong et al.
(Continued)

FOREIGN PATENT DOCUMENTS

CN 1853521 A 11/2006
CN 1939180 A 4/2007
(Continued)

OTHER PUBLICATIONS

Office Action with Search Report dated Jan. 25, 2018 issued in parallel Chinese Patent App. No. 201580072320.0 (13 pages with English translation).
(Continued)

*Primary Examiner* — Victor D Batson
*Assistant Examiner* — Matthew J Sullivan
(74) *Attorney, Agent, or Firm* — Haynes and Boone, LLP

(57) ABSTRACT

A slider garage includes an overmolded body, the overmolded body oriented on a zipper, the overmolded body including an overmolded male portion and an overmolded female portion, the overmolded male and female portions positioned on an end of the zipper, such that each is on one side of the zipper, the overmolded male portion being shaped such that it fits in the overmolded female portion in a watertight fashion and the overmolded body is molded over a portion of the zipper.

16 Claims, 17 Drawing Sheets

Related U.S. Application Data application No. PCT/US2015/063451, filed on Dec. 2, 2015.

(60) Provisional application No. 62/087,687, filed on Dec. 4, 2014.

(56) References Cited

U.S. PATENT DOCUMENTS

| | | | | |
|---|---|---|---|---|
| 3,101,109 | A * | 8/1963 | Hawley | A44B 19/267 150/157 |
| 4,223,425 | A | 9/1980 | Akashi | |
| 4,524,493 | A | 6/1985 | Inamura | |
| 4,825,514 | A | 5/1989 | Akeno | |
| 4,947,525 | A | 8/1990 | Van Erden | |
| 5,189,764 | A | 3/1993 | Herrington | |
| 5,608,952 | A * | 3/1997 | Wilder | A44B 19/388 24/433 |
| 5,681,115 | A | 10/1997 | Diederich | |
| 5,947,603 | A | 9/1999 | Tilman | |
| 7,565,722 | B2 * | 7/2009 | Kusayama | A44B 19/386 24/388 |
| 8,104,147 | B2 * | 1/2012 | Peano | A44B 19/26 24/387 |
| 8,677,570 | B2 * | 3/2014 | Swain | B65D 33/2591 24/30.5 L |
| 9,295,307 | B2 * | 3/2016 | Tominaga | A44B 19/32 |
| 9,538,817 | B2 * | 1/2017 | Ogura | A44B 19/32 |
| 9,545,134 | B1 * | 1/2017 | Tan | A44B 19/32 |
| 2003/0115725 | A1 | 6/2003 | Matsumoto et al. | |
| 2003/0213106 | A1 * | 11/2003 | Ichikawa | A44B 19/388 24/433 |
| 2003/0231809 | A1 | 12/2003 | Bentsen | |
| 2006/0075612 | A1 * | 4/2006 | Wu | A44B 19/388 24/433 |
| 2006/0236510 | A1 | 10/2006 | Kusayama et al. | |
| 2007/0067969 | A1 * | 3/2007 | Kusayama | A44B 19/32 24/436 |
| 2007/0226965 | A1 * | 10/2007 | Cossutti | A44B 19/32 24/389 |
| 2007/0245529 | A1 * | 10/2007 | Stewart | A44B 19/267 24/415 |
| 2007/0266532 | A1 | 11/2007 | Katada et al. | |
| 2009/0019675 | A1 | 1/2009 | Peano | |
| 2009/0307880 | A1 * | 12/2009 | Brightman | A44B 19/32 24/399 |
| 2011/0126383 | A1 | 6/2011 | Takazawa et al. | |
| 2012/0311785 | A1 | 12/2012 | Goldberg | |
| 2013/0074293 | A1 * | 3/2013 | Mikuma | A44B 19/32 24/430 |
| 2013/0287322 | A1 | 10/2013 | Gong | |
| 2014/0366336 | A1 * | 12/2014 | Chung | A44B 19/32 24/389 |

FOREIGN PATENT DOCUMENTS

| | | | | |
|---|---|---|---|---|
| CN | 101380160 | A | 3/2009 | |
| CN | 102917614 | A | 2/2013 | |
| CN | 203735601 | U | 7/2014 | |
| CN | 105120702 | A | 12/2015 | |
| EP | 1714575 | A1 | 10/2006 | |
| JP | 2006-296732 | | 11/2006 | |
| JP | 2007089898 | A | 4/2007 | |
| WO | WO-9909854 | A1 * | 3/1999 | A44B 19/16 |
| WO | WO 9909854 | A1 | 3/1999 | |
| WO | WO 02/03824 | A1 | 1/2002 | |
| WO | WO 02/102181 | A1 | 12/2002 | |

OTHER PUBLICATIONS

Office Action dated Oct. 24, 2017 issued in parallel Japanese Patent App. No. 2017-529707 (8 pages).

PCT Search Report issued in related PCT App. No. PCT/US2015/063451 dated Feb. 23, 2016 (3 pages).

International Preliminary Examination Report on Patentability and Written Opinion issued in related PCT App. No. PCT/US2015/063451 dated Feb. 23, 2016 (6 pages).

Supplementary European Search Report and Search Opinion dated Sep. 26, 2018 issued in related European Patent App. No. 15865178.6 (6 pages).

Office Action dated Apr. 10, 2019 issued in parallel Chinese Patent App. No. 201580072320.0 (12 pages).

International Search Report and Written Opinion dated Jul. 29, 2019 issued in related PCT/US2019/032518 (10 pages).

European Search Report dated Feb. 4, 2020 issued in European Patent App. No. 19208372.3 (8 pages).

* cited by examiner

SYSTEMS AND METHODS FOR IMPROVED ZIPPER SLIDER GARAGE

CROSS-REFERENCES TO RELATED APPLICATIONS

This application is a continuation-in-part of U.S. patent application Ser. No. 15/612,926 filed Jun. 2, 2017 which is a continuation of PCT Application No. PCT/US2015/063451 filed on Dec. 2, 2015, which PCT application claims the benefit of U.S. Provisional Application No. 62/087,687 filed Dec. 4, 2014. The above patent applications are hereby incorporated by reference to the same extent as though fully contained herein.

BACKGROUND

A weak point in many zippers that are intended to be waterproof is at the final closure point of the zipper. In many zipper configurations, a small but significant aperture will exist at the zipper closure point. Depending on the performance required by the waterproof nature of the zipper, even such a small aperture is unacceptable.

Most, if not all, polymer zipper systems are made from Olefin-based polymers like polypropylene or polyethylene. Polymer zipper profiles are manufactured using an extrusion process. Olefin-based systems are prevalent in many polymer zipper systems due to the inherent low cost of the polymer resin and its low coefficient of friction properties. A low coefficient of friction is important so that the ball and socket of the zipper can be pushed together with minimal effort. However, Olefin-based zipper systems have their limitations. Most Olefin-based zipper systems made from polypropylene and polyethylene are not durable when used in exterior environments where temperature extremes affect the performance of the material. Polypropylene and polyethylene zipper profiles lack tensile and tear strength and good elongation properties. They also have excessive compression set when exposed to stress loads at higher temperatures. Therefore, they are not used for extreme applications such as "drybags" and "wet-suits" that are often used in hot environments. Rather, they are used for sandwich bags and other low performance applications.

SUMMARY

In one embodiment, a slider garage includes an overmolded body, the overmolded body oriented on a zipper, the overmolded body including an overmolded male portion and an overmolded female portion, the overmolded male and female portions positioned on an end of the zipper, such that each is on one side of the zipper, the overmolded male portion being shaped such that it fits in the overmolded female portion in a watertight fashion and the overmolded body is molded over a portion of the zipper. Alternatively, the zipper includes a male side and a female side, and the overmolded male portion is positioned on the male side of the zipper and the overmolded female portion is positioned on the female side of the zipper. In one alternative, the overmolded body forms a u-shape and the overmolded male portion and the overmolded female portion are part of the u-shape. In another alternative, the overmolded male portion and the overmolded female portion are on the interior of the overmolded body where a first and second side of the overmolded body meet when a slider is engaged in the slider garage. Alternatively, the zipper interfaces with the overmolded body without interruption. In another alternative, the zipper includes a continuous top edge. Alternatively, a flange of the zipper is not exposed between the zipper and the overmolded body. In another alternative, there is no break in the zipper in the along a length of the zipper. Alternatively, there is no break between the zipper along the length of the zipper and the slider garage.

In one embodiment, a slider garage includes an overmolded body, the overmolded body located on an end of a zipper, the overmolded body providing a waterproof seal when engaged with a slider, wherein the overmolded body is molded over a portion of the zipper. In on alternative, the overmolded body forms a u-shape and an overmolded male portion and an overmolded female portion are part of the u-shape. In another alternative, the overmolded male portion and the overmolded female portion are on the interior of the overmolded body where a first and second side of the overmolded body meet when a slider is engaged in the slider garage. Alternatively, the zipper interfaces with the overmolded body without interruption. In another alternative, the zipper includes a continuous top edge. Alternatively, a flange of the zipper is not exposed between the zipper and the overmolded body. In another alternative, there is no break in the zipper in the along a length of the zipper. Alternatively, there is no break between the zipper along the length of the zipper and the slider garage.

In one embodiment, a slider garage includes an overmolded body, the overmolded body oriented on a zipper, the overmolded body including an overmolded male portion and an overmolded female portion, the overmolded male and female portions positioned on an end of the zipper, such that each is on one side of the zipper, the overmolded male portion being shaped such that it fits in the overmolded female portion in a watertight fashion, wherein the overmolded body is molded over a portion of the zipper. Alternatively, the zipper includes a male side and a female side, and the overmolded male portion is positioned on the male side of the zipper and the overmolded female portion is positioned on the female side of the zipper. In one alternative, the overmolded body forms a u-shape and the overmolded male portion and the overmolded female portion are part of the u-shape. In another alternative, the overmolded male portion and the overmolded female portion are on the interior of the overmolded body where a first and second side of the overmolded body meet when a slider is engaged in the slider garage.

In one embodiment, a slider garage includes an overmolded body, the overmolded body oriented on a zipper, the overmolded body including an overmolded male portion and an overmolded female portion, the overmolded male and female portions positioned on an end of the zipper, such that each is on one side of the zipper, the overmolded male portion being shaped such that it fits in the overmolded female portion in a watertight fashion. Optionally, the zipper includes a male side and a female side, and the overmolded male portion is positioned on the male side of the zipper and the overmolded female portion is positioned on the female side of the zipper. Alternatively, the slider garage further includes an inner wall in the overmolded body, wherein the inner wall is sized to have a height that causes the inner wall to seal against a slider when it is advanced to an end of the slider garage distal from the zipper. Optionally, the inner wall includes an incline portion, such that the incline portion forms a ramp for the slider to gradually seal against the inner wall. In one configuration, the inner wall of the slider garage includes a portion distal from the zipper, the portion distal from the zipper having an approximate u-shape and the inner wall of the slider garage includes a zig-zag shaped portion, the zig-zag shaped portion having a first portion on a male side of the zipper which is the side including the overmolded male portion and a second portion on a female side of the zipper which is the side including the overmolded female portion, an end of the zig-zag shaped portion proximate to the zipper having a first position and a second position, the first position characterized by the first portion on the male side of the zipper being immediately adjacent to the second portion on the female side of the zipper when the slider is engaged in the slider garage and the second position characterized by the first portion on the male side of the zipper being away from the second portion on the female side of the zipper when the slider is not engaged in the slider garage, and the first and second portions include the incline portion. Optionally, the overmolded female portion and the overmolded male portion have a first position and a second position, the first position characterized by the overmolded female portion and the overmolded male portion not being engaged, and the second position characterized by the overmolded female portion and the overmolded male portion being engaged. Alternatively, the shape and positioning of the overmolded female portion and the overmolded male portion cause the overmolded female portion to be pushed vertically upward and the overmolded male portion to be pushed vertically downward when the overmolded female portion and the overmolded male portion have a first position and a second position and are in the second position. Optionally, the inner wall is surrounded by a side wall, and the side wall is interconnected with the inner wall via a plurality of supports. Alternatively, the overmolded body includes a transition line wherein the transition line defines the line which the slider must pass to complete a seal of the zipper and slider garage. In one alternative, the transition line is approximately in line with the male and female overmolded portions. In another alternative, a first portion of the zipper on a first side where the overmolded male portion is located extends further into the overmolded body than a second portion of the zipper on a second side where the overmolded female portion is located. Optionally, the overmolded body is made of thermoplastic polyurethane. In another alternative, the overmolded body has a durometer between 60 and 90 shore A. Alternatively, the overmolded body portion is textured to reduce adhesion. Optionally, the thermoplastic polyurethane includes a slip agent.

In another embodiment, a slider garage includes an overmolded body, the overmolded body located on an end of a zipper, the overmolded body providing a waterproof seal when engaged with a slider. Optionally, the overmolded body includes a male overmolded portion and a female overmolded portion, wherein the male overmolded portion fits into the female overmolded portion to form the waterproof seal when engaged with the slider. Alternatively, a height of the overmolded body is such that the overmolded body seals against the slider when the slider engages the overmolded body. Optionally, the overmolded body includes a ramp to ease the transition from a sealed to a non-sealed state. Alternatively, the overmolded body is made of thermoplastic polyurethane. In one alternative, the overmolded body has a durometer between 60 and 90 shore A.

In another embodiment, a slider garage includes an overmolded body, the overmolded body oriented on a zipper, the overmolded body including an overmolded male portion and an overmolded female portion, the overmolded male and female portions positioned on an end of the zipper, such that each is on one side of the zipper, the overmolded male portion being shaped such that it fits in the overmolded female portion in a watertight fashion. The overmolded female portion and the overmolded male portion have a first position and a second position, the first position characterized by the overmolded female portion and the overmolded male portion not being engaged, and the second position characterized by the overmolded female portion and the overmolded male portion being engaged. Optionally, the shape and positioning of the overmolded female portion and the overmolded male portion cause the overmolded female portion to be pushed vertically upward, the overmolded male portion to be pushed vertically downward when the overmolded female portion and the overmolded male portion have a first position and a second position and are in the second position. Alternatively, the slider garage further includes an inner wall in the overmolded body, wherein the inner wall is sized to have a height that causes the inner wall to seal against a slider when it is advanced to an end of the slider garage distal from the zipper. Alternatively, the inner wall includes an incline portion, such that the incline portion forms a ramp for the slider to gradually seal against the inner wall.

DETAILED DESCRIPTION OF THE DRAWINGS

Described herein are embodiments of an improved zipper slider garage (referred to as "slider garage" at times) and methods of using it and making it. Of the many advantageous aspects of the improved zipper slider garage, the slider garage includes a shape that provides for an interference fit between the slider of the zipper and the slider garage. This interference fit provides for a seal at the end of the zipper making the zipper waterproof. Although this is a feature that makes the slider garage waterproof, there are many additional features that serve to make the slider garage function in a user friendly and optimal fashion. These features include the male side of the zipper extends further into the slider garage than the female side, the sliding lock mechanism of the zipper, the material of the zipper and the slider garage, and the flexible design of the slider garage.

Figure 1:
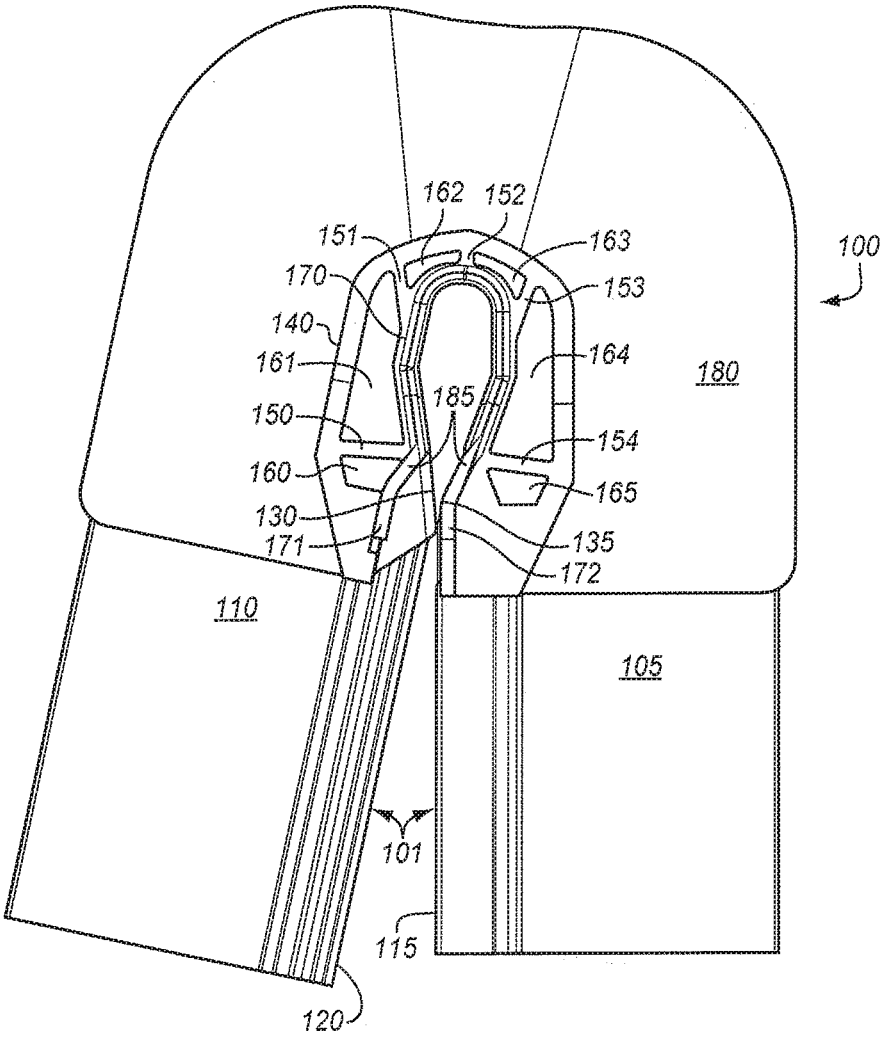
FIG. 1 shows a top view of one embodiment of a slider garage and zipper.

FIG. 1 shows one embodiment of a slider garage 100. In some configurations, the slider garage 100 is an overmolded extrusion. Slider garage 100 is overmolded onto a waterproof zipper 101 that includes male side 120 and female side 115. Male side 120 and female side 115 of zipper 101 each include flanges 110, 105 that are used to attach the zipper 101 to a bag or other object. In operation, the sides of zipper 101 come together and close the bag or other object. In practice, the very end of zipper 101 where the slider would rest may not be completely waterproof and may be prone to opening if the slider garage 100 was not utilized.

Figure 6:
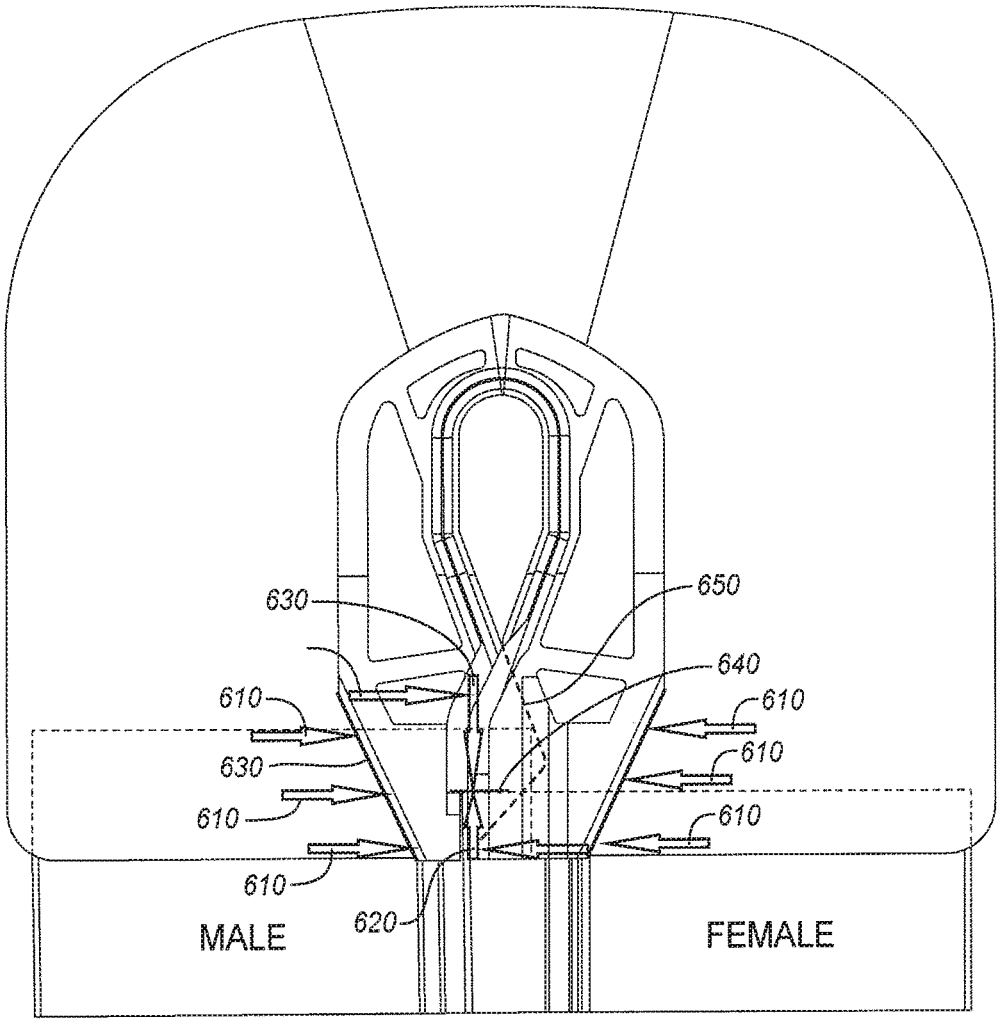
FIG. 6 show various pressures exerted during the engagement of the slider with the slider garage of FIG. 1.

Many aspects of the slider garage 100 are visible in FIG. 1. Slider garage 100 includes an overmolded male portion 130 and an overmolded female portion 135. The overmolded male portion 130 and overmolded female portion 135 cooperate to ensure a waterproof seal is formed (in the transition) between the slider garage 100, the male side 120, and the female side 115 of zipper 101 when fully engaged by the slider (the slider is not shown here). As the slider engages the slider garage 100, it applies sideways inward pressure that pushes overmolded male portion 130 and overmolded female portion 135 together horizontally. Simultaneously, this inward pressure pushes the overmolded female portion 135 vertically upward, and because of the overmolded male portion's 130 shape and the overmolded female portion's 135 reciprocal overmolded shape, this inward pressure pushes the overmolded male portion 130 vertically downward where the two parts meet and engage in a locked sealing position. FIG. 6 depicts this sealing position. The locked sealing position compresses the overmolded male portion 130, forming a tight seal.

FIG. 1 also shows the side wall 140, supports 150, 151, 152, 153, 154, voids 160-165, and inner wall 170 of the slider garage 100. Inner wall 170 also includes incline portions 171, 172. Finally, slider garage 100 also includes flange 180 that provides for flexibility and sealing to the bag or other item. Various embodiments of the slider garage 100 may not include some of these aspects and may still function; although, in many embodiments, the incline portions 171, 172 are used for sealing. In order for optimal functioning, it is important to maintain a slider garage that has a balance of stiffness and flexibility. This balance enables smooth operation of the slider on zipper 101 and slider garage 100.

When broken down to the simple components that seal the zipper 101, transition point 185 is important to recognize. As a slider moves down zipper 101 and begins to engage slider garage 100, the inner portion of the slider begins to engage the incline portions 171, 172. After the down facing inner portion of the slider passes transition point 185, the waterproof seal is formed. The seal may form for a number of reasons including, but not limited to, the engagement of the male and female overmolded portions and the engagement of the slider with the slider garage. This might be accomplished without incline portions 171, 172; and slider garage 100 might have a hard transition, in some alternatives, at point 185, from providing no contact and/or interference with the down facing inner portion of the slider to an amount of interference that seals the zipper 101 and slider garage 100. As can be discerned, the slider would be difficult to operate in such a scenario, since the slider and the slider garage 100 would have to flex significantly over a short distance. This would require a lot of force from the user. Therefore, a first aspect of the innovation in the slider garage 100 is that the slider seals against inner wall 170, making the closure waterproof. Another innovation is that incline portions 171, 172 make the transition of the slider into a sealed position gradual, utilizing the wedge that incline portions 171, 172 provide. Pulling the slider towards the wedge provides an upward force approximately perpendicular to the movement of the slider. The aspect of incline portions 171, 172 make the zipper 101 easier to operate.

In some configurations, even with the inclusion of incline portions 171, 172, the zipper may still be difficult to operate. In order to have a strong seal, inner wall 170 must be rigid enough to avoid flexing in such a way to break the seal between the slider and the inner wall 170. In order to accomplish this, inner wall 170 may be thickened or made of stiffer material. Although this ensures a seal, engaging and disengaging a slider from slider garage 100 may be more difficult due to the lack of give and flex. In order to enable a thinner and more flexible inner wall 170, side wall 140, supports 150, 151, 152, 153, 154, and voids 160-165 have been included in many embodiments. These side walls 140, supports 150, 151, 152, 153, 154, and voids 160-165 provide for both flexibility of slider garage 100 and stiffness to resist unwanted release of the seal between the slider and slider garage 100.

Note that supports 150, 154 approximately coincide with transition point 185. This is an important location on slider garage 100. Since transition point 185 is the primary point where seal is achieved, this point in many configurations is optimized by including supports 150, 154 at the same point. Therefore, slider garage 100 is prevented from flexing greatly at this point, while at the same time more flex is enabled before and after the transition point 185 by voids 160, 161, 164, 165. The other supports and voids function in a similar fashion to enable flexion and support. Similarly, flange 180 may assist in providing give and flexion to the entire device.

In addition to the structure of slider garage 100, the material that is used is optimized as well. Typically, zipper 101, the slider, and slider garage 100 are composed of TPU (Thermoplastic polyurethane). Unlike Olefin-based plastics, TPUs are crosslinked polymer elastomers that exhibit rubber-like properties at high and low durometers. TPU polymers exhibit extremely high tensile and tear strengths and high elongation properties at high and low temperature extremes. TPU polymers also exhibit superior compression set resistance. TPU polymers are designed for use in extreme outdoor applications. In sealing applications, such as slider garage parts, relatively low durometer material is used because of its excellent sealing properties that include being soft/malleable and tacky/being able to stick to itself. The side effect of these excellent sealing properties is that they also tend to be tacky and "stick" to other materials on contact. In a slider garage application, because of the interference fit between the slider and slider garage 100, this effect is amplified, making the slider somewhat problematic to fully engage and disengage slider garage 100. As a solution in some alternatives, slider garage 100 is made of a compounded material. The compound consists of a 75 A durometer TPU material and a slip agent. This specific combination of materials produces a part that retains excellent sealing properties and at the same time allows the slider to easily engage and disengage slider garage 100. Additionally, in alternatives, the TPU material may be textured. Light regular and irregular textures may be applied to the TPU material. These textures are typically between 0.01 millimeters and 1 millimeter in depth, size, and spacing, where the arrangement may be a combination of different depths, sizes, and spacing as well. Typically, these textures are less than 0.1 millimeters in depth. The textured nature of the TPU may prevent the TPU from sticking or adhering to itself and may increase ease of use in sliding parts past each other.

Figure 2:
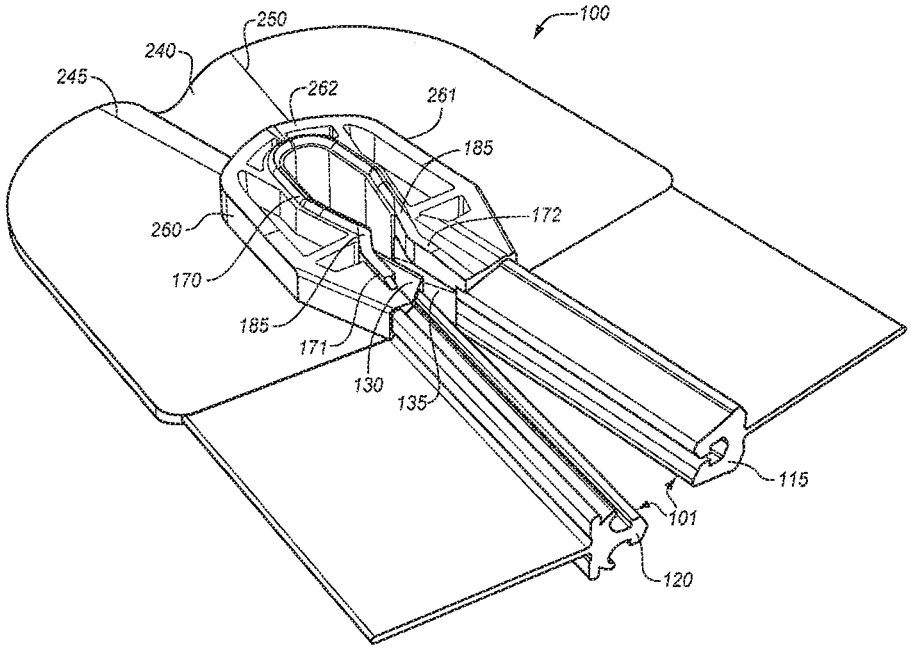
FIG. 2 shows a perspective view of the slider garage of FIG. 1.

FIG. 2 shows a perspective view of the slider garage. In this view, many aspects of zipper 101 and slider garage 100 are visible. The sloped nature of incline portions 171, 172 is visible in this view, as is the raised nature of inner wall 170. Also, the overmolded male portion 130 and overmolded female portion 135 are more clearly visible. Here it can be seen how the overmolded male portion 130 fits into the overmolded female portion 135 and effectively caps zipper 101 over the protruding ball portion 210 of male side 120 that fits into the socket 115 of female side 220. This helps to create a more effective seal. Slide garage 100, in many embodiments, is designed to work with a ball-in-socket type of zipper as shown in FIG. 2. In this type of zipper, ball portion 210 of male side 120 is pressed into socket 220 of female side 115. The male and female 120, 115 flex and slide in relation to each other to create this engagement, and certain pieces of zipper 101 may be made more or less flexible to provide for stiffness where needed and flexibility to provide for engagement. Slip coatings or materials embedded with slip coatings also may be utilized. Also in this view, a portion 240 of flange 180 has been segmented such that it may more easily flex between flex lines 245, 250. These flex lines 245, 250 provide for flexion of flange 180 in a more complementary place for the function of the zipper and tend to provide for flexion away from sides 260, 261 of slider garage 100 and provide flexion, instead, at end 262. This helps support the continued integrity of slider garage 100 and inner wall 170 of slider garage 100, which is important for waterproof sealing.

Figure 3:
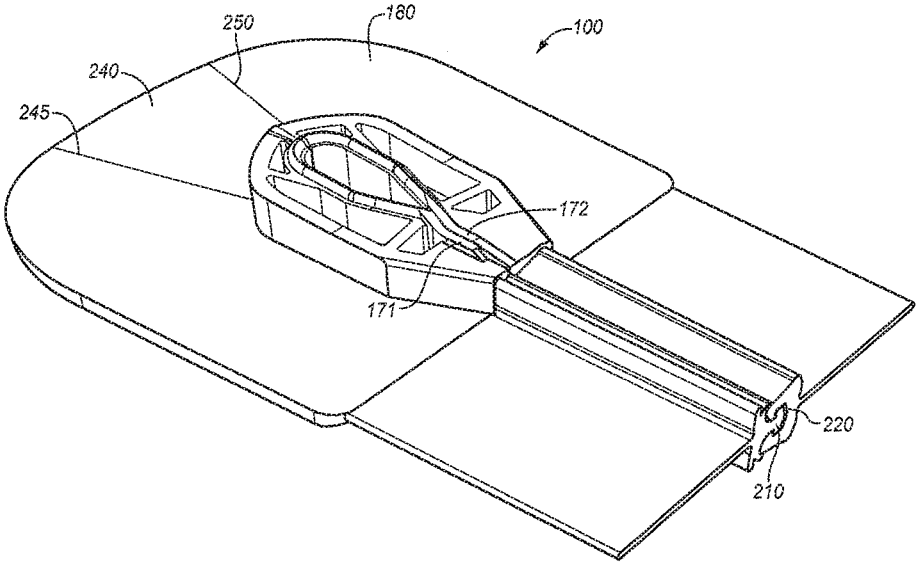
FIG. 3 shows a perspective view of the slider garage of FIG. 1 in a fully engaged position.

FIG. 3 shows a perspective view of slider garage 100 in a fully engaged position. In this position, incline portions 171, 172 have been pressed together tightly and the adhesive quality of slider garage 100 material will further provide for a tight fit and resistance to the penetration of water. Here it is clear how ball portion 210 engages socket 220 to close the main portion of zipper 101.

Figure 4:
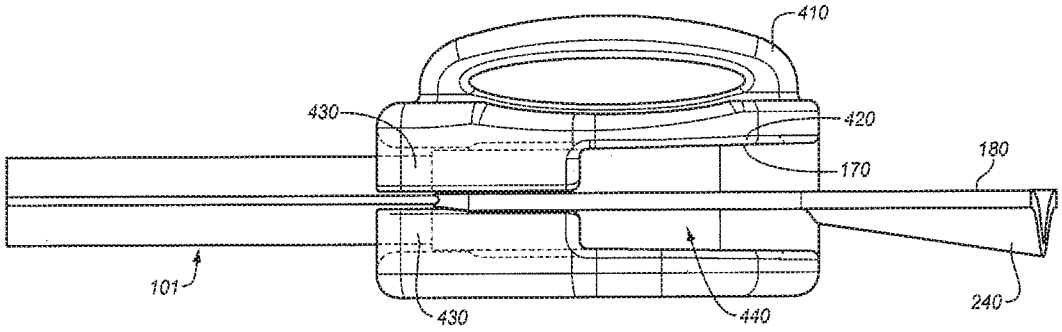
FIG. 4 shows a side view of the slider garage of FIG. 1 with a slider engaged.

FIG. 4 shows a side view of slider garage 100 with a slider 410 engaged. The inner wall 170 engages with the bottom inner surface 420 which is partially visible in the view provided. Slider side walls 430 and open area 440 of slider 410 function to gradually apply pressure to the side walls of slider garage 100 and assist in keeping a firm seal. Here it also is noted that the opposing side of slider garage 100 that is not shown in many of the figures also may be a raised inner wall that engages the upward facing inner surface of slider 410. This may be omitted in some embodiments, since the bottom of slider garage 100 is generally interior to the bag or other object that is intended to be waterproof.

Figure 5:
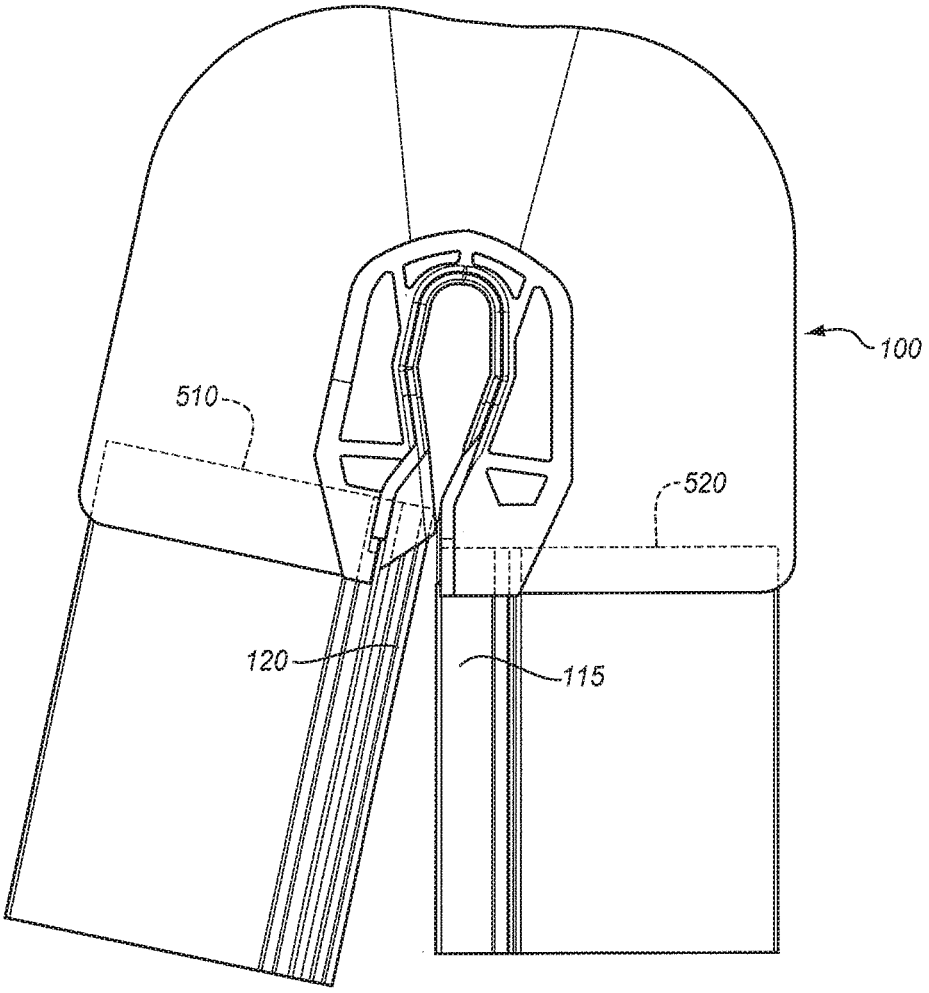
FIG. 5 shows a top view of the slider garage of FIG. 1.

FIG. 5 shows how the male side 120 of zipper 101 extends further to line 510 into slider garage 100 as opposed to the female side 115 which extends to line 520. This is optimal because, in order for overmolded female portion 135 to receive overmolded male portion 130, female side 115 must terminate sooner than male side 120, since the void needed for overmolded female portion 135 is deeper than that of female side 115 of zipper 101. Also, as is visible in this figure, slider garage 100 may extend farther down female side 115 without interfering with the operation of zipper 101.

FIG. 6 show various pressures exerted during the engagement of the slider with slider garage 100. As the slider advances toward the end of slider garage 100, the slider exerts an inward horizontal pressure 610 on the sides of slider garage 100. The horizontal pressure 620 of the slider pushes the overmolded male portion 130 in a vertically downward direction 630 as it interacts with the overmolded female portion 135. At line 640, the overmolded male portion 130 and the overmolded female portion 135 meet, with overmolded male portion 130 extending to line 650, and engage to create a locked sealing position that prevents water from passing the seal.

Figure 7:
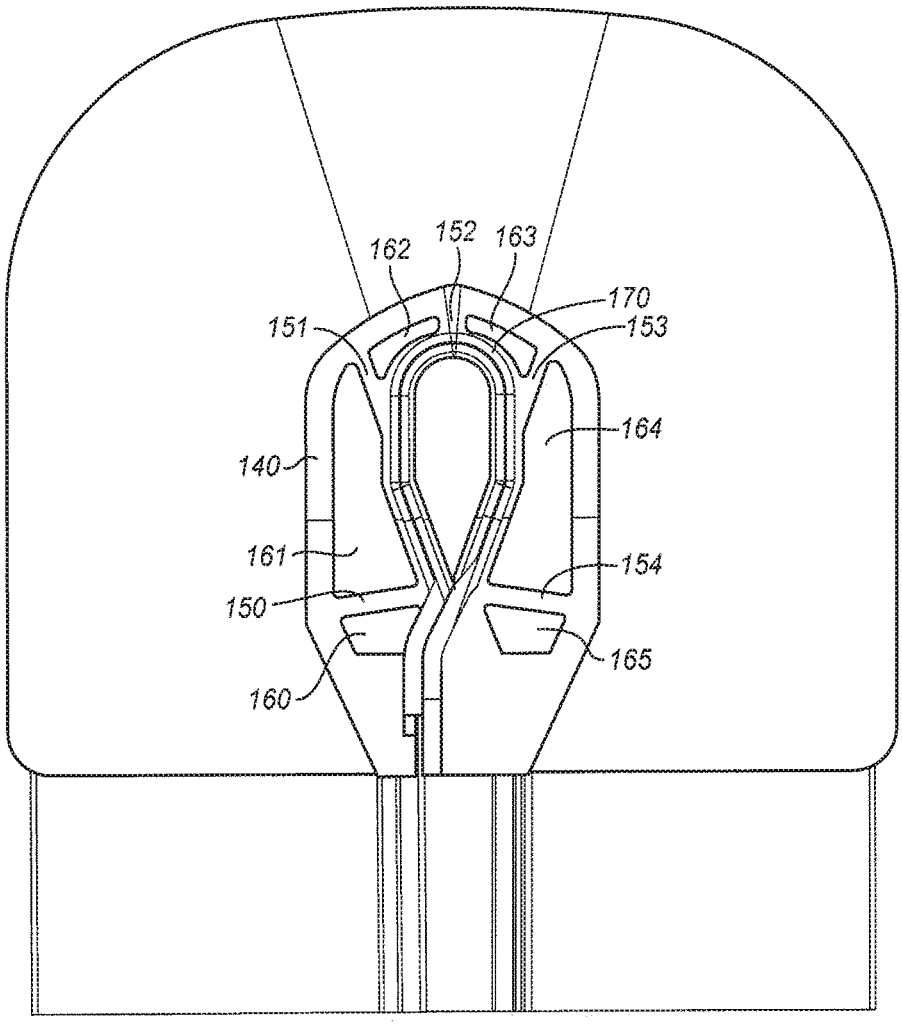
FIG. 7 shows an engaged view of the slider garage of FIG. 1.

FIG. 7 shows an engaged view of side wall 140, supports 150, 151, 152, 153, 154, voids 160-165, and inner wall 170 of slider garage 100.

Figure 8:
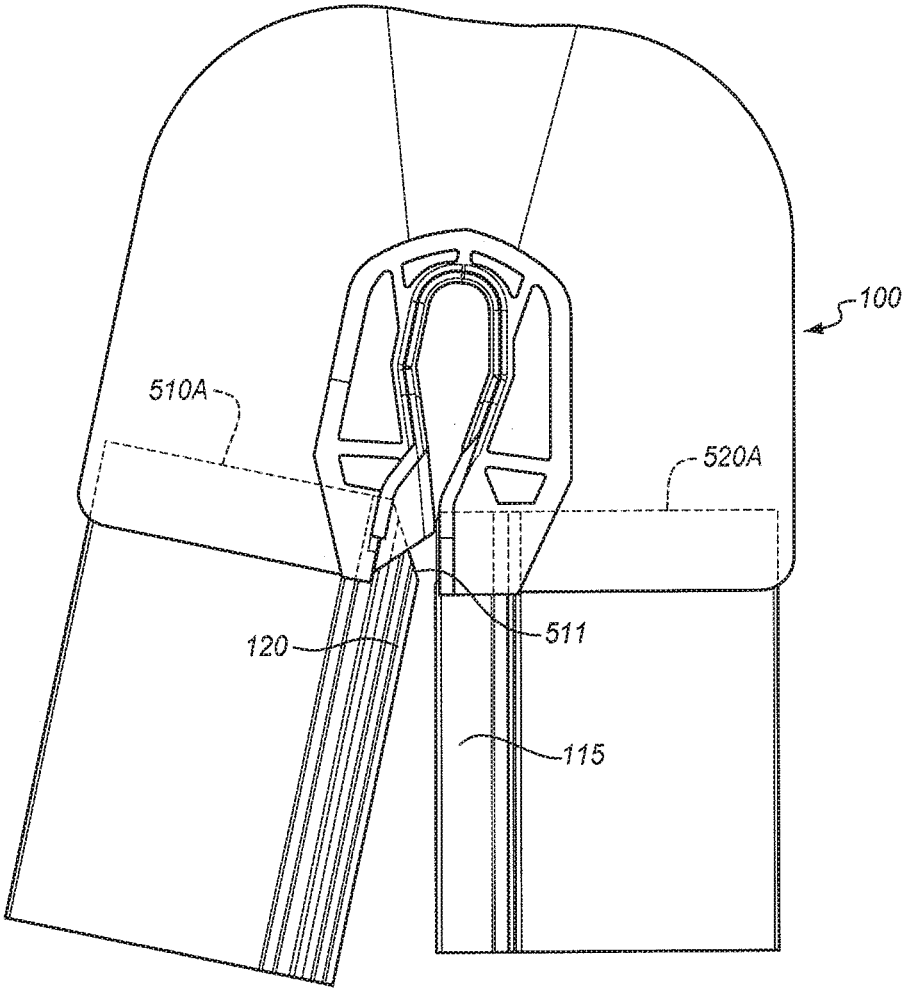
FIG. 8 shows another embodiment of a slider garage.

FIG. 8 shows another embodiment of how the male side 120 of zipper 101 extends to line 510A into slider garage 100 a similar or same distance to the female side 115 which extends to line 520A. Additionally, the female side includes diagonal cut 511 which provides for the insertion of the overmolded male portion 130. Without this diagonal cut, the male side 120 would interfere with the insertion of the overmolded male portion 130.

Figure 9A:
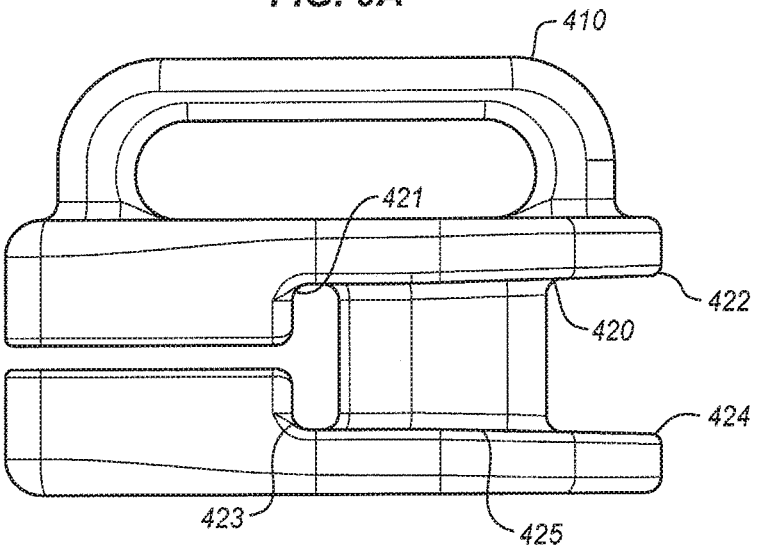
FIGS. 9A and 9B show a side view of the slider garage of FIG. 1 with a slider prior to engagement.
Figure 9B:
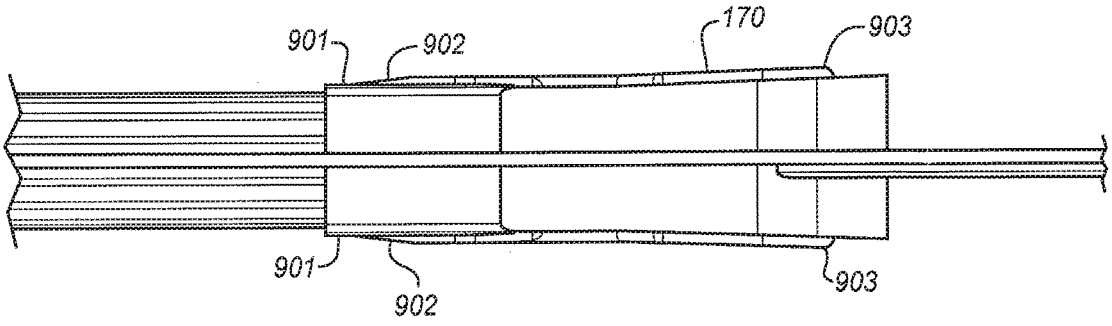

FIG. 9A shows side view of the slider 410. In this figure, the inclined nature of the interior portion of the slider 410 is visible. Bottom inner surface 420 is sloped from point 421 to point 422 and similarly sloped on inner surface 425 from point 423 to point 424. This results in the mouth of slider 410 being wider than the back end near points 421, 423. FIG. 9B additionally shows the slope of slider garage 100. Slider garage 100 includes a ramped portion from point 901 to point 902 where the slider 410 initially engages slider garage 100. Additionally, from point 902 to point 903, the thickness of the slider garage 100 gradually increases, providing for a water tight seal between inner wall 170 while engaged with the bottom inner surface 420 and inner surface 425. In principal, the slider garage and slider combination provides for an interference type seal as the slider is pressed against the slider garage. The resulting height of the slider garage is slightly less than the height of the slider when the two are fully engaged. The material of the slider and slider garage are flexible and deformable such that, as they move in respect to each other along their respective inclines, they may fully engage and form a seal.

In many embodiments, the interior of the zipper garage itself includes a male and female portion. This can be seen in FIG. 2 which shows how overmolded male portion 130 fits into the overmolded female portion 135. Additionally, it is apparent from the figures that there is no break in the continuity of the zipper slide from zipper portion itself to the garage. This is unlike other zipper systems with teeth that include a garage, the transition to the garage from the main zipper portion is seamless and smooth, increasing zipper usability. Additionally, as is visible in FIG. 6, the primarily motion of the zipper, is merely that the male and female portions move towards and away from each other in a single plane. Many other toothless zippers that rely on hooks require movement in two planes of motion to engage and disengage. This is not so with the zipper shown. Similarly, the garage itself merely moves in a single plane to seal and unseal. In many embodiments, the slider garage includes a u-shaped portion having a male and female portion as part of the u-shaped portion. In many embodiments, the male and female portion that are part of the u-shaped portion are on the interior of the slider garage where the sides of the slider garage meet when the slider is engaged in the garage. In many embodiments, the zipper interfaces without interruption with the slider garage. In many embodiments, the zipper portion is continuous on a top edge of the device. In many embodiments, the flange is not exposed between the zipper and the slider garage. In many embodiments, there is no break in the zipper in the along the length of the zipper. In many embodiments, there is no break between the zipper along the length of the zipper and the slider garage. In many embodiments the zipper and the slider garage are immediately adjacent, such that they touch. In many embodiments, the slider garage is molded over a portion of the zipper.

Figure 10A:
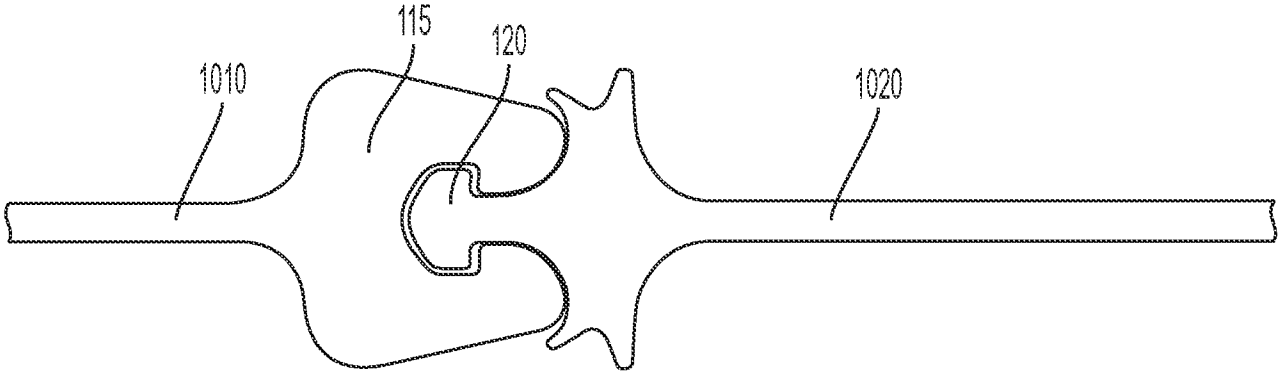
FIG. 10A and FIG. 10B show profile views of a cross-section of two embodiments of the zipper.
Figure 10B:
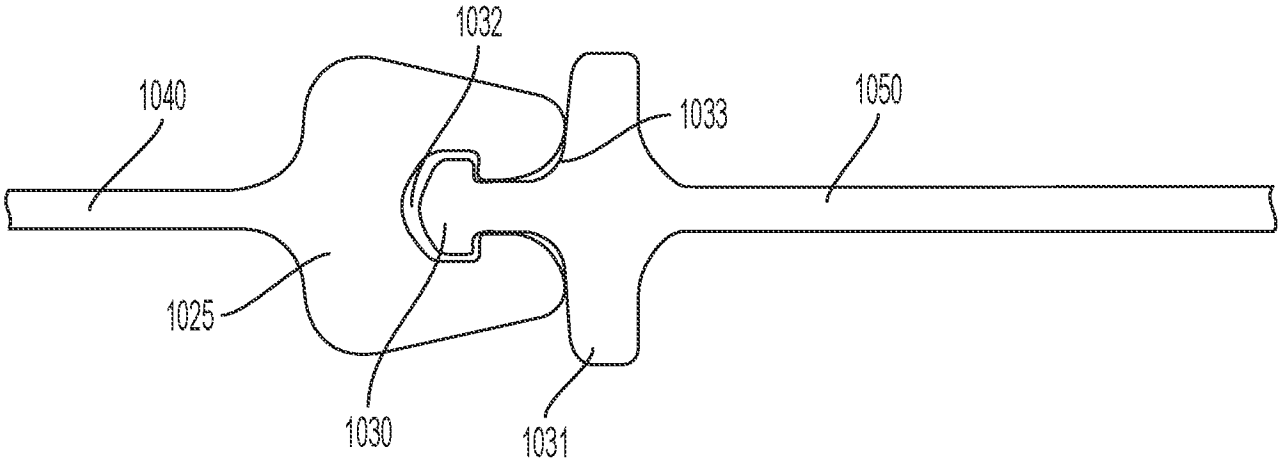

FIG. 10A and FIG. 10B show profile views of a cross-section of two embodiments of the zipper. In FIG. 10A a first zipper design is show having male side 120 and female side 115. Flange 1010 and flange 1020 may be used to attach the zipper to a bag or other item. FIG. 10B shows another embodiment. In this embodiment, female portion 1025 receives male portion 1030. A vacuum air pocket 1032 is created between the two. Additionally, a second intermediate space 1033 may be formed between female portion 1025 receives male portion 1030 that provides for more ready detachment of the sides, as the intermediate space/void provides for an area that provides for additional give in the system. Additional, cross portion 1031 has been made smoother and more regular as compared to previous embodiments. This improved cross section provides for easier movement of the slider portion, providing less friction.

Figure 11:
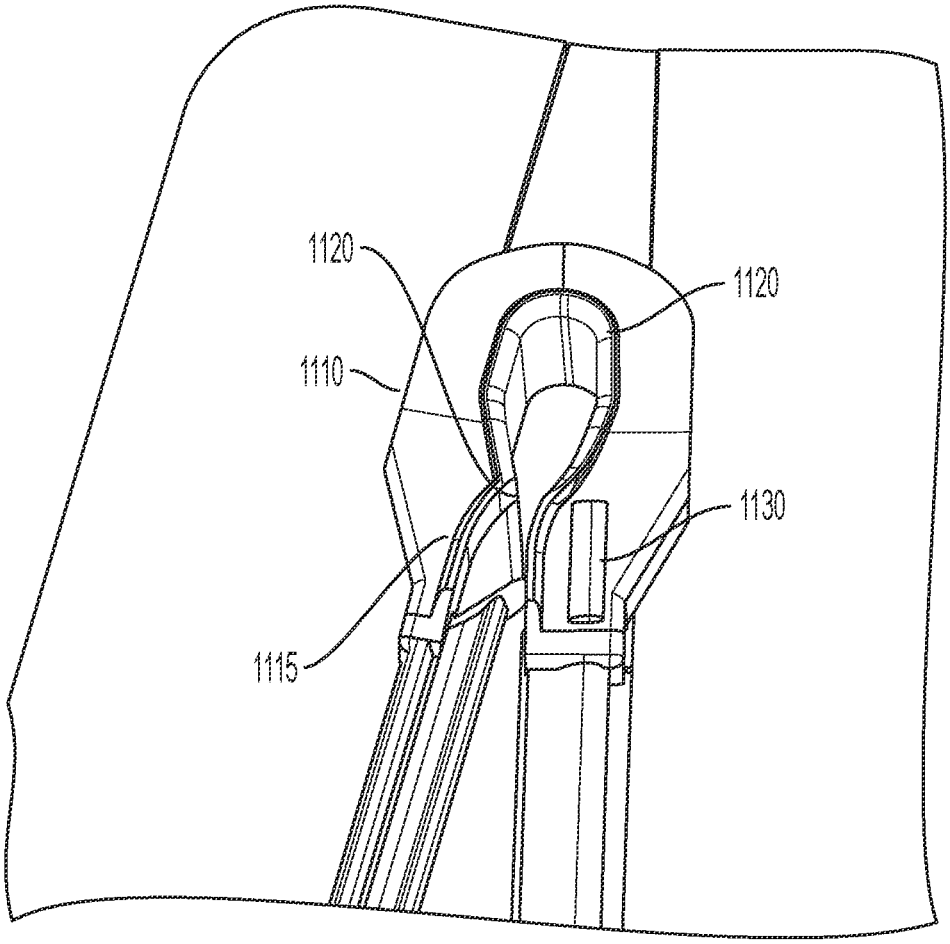
FIG. 11 shows an alternative embodiment of a zipper garage.

FIG. 11 shows an alternative embodiment of a zipper garage 1110. In this embodiment, male portion 1115 fits into female portion 1120. Male portion 1115 extends beyond the male protrusion on the side that it sits, and the angled edge on the interior of the zipper provides for a gradual transition from the male portion 1115 to the interion of the zipper. This also provides for smooth insertion and removal from the corresponding female portion, since as compared to a more perpendicular protrusion, this portion is angled according to the angle of separation of the sides. Additionally, the zipper garage 1110 includes a raised flange 1120 (this exists on both sides of the zipper). This raised flange seals against the interior of the zipper and prevents water from traveling in to the aperture in the middle of the garage. Additionally, the zipper garage includes a raised portion 1130. This portion assists in the molding of the device and helps assure sufficient material is extruded to fill the garage. Additionally, this may assist in holding the slider in place when it engages the zipper garage.

Figure 12B:
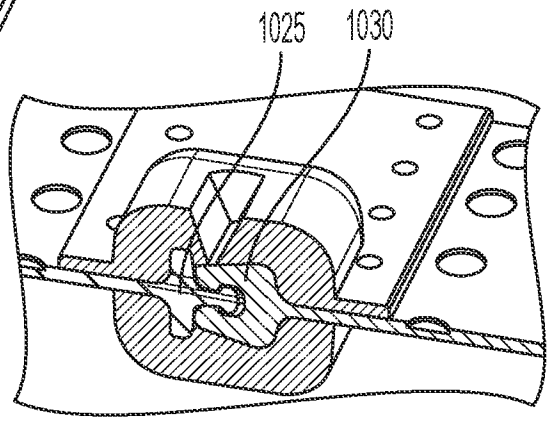
FIGS. 12A and 12B show the end of the zipper opposite the zipper garage.
Figure 12A:
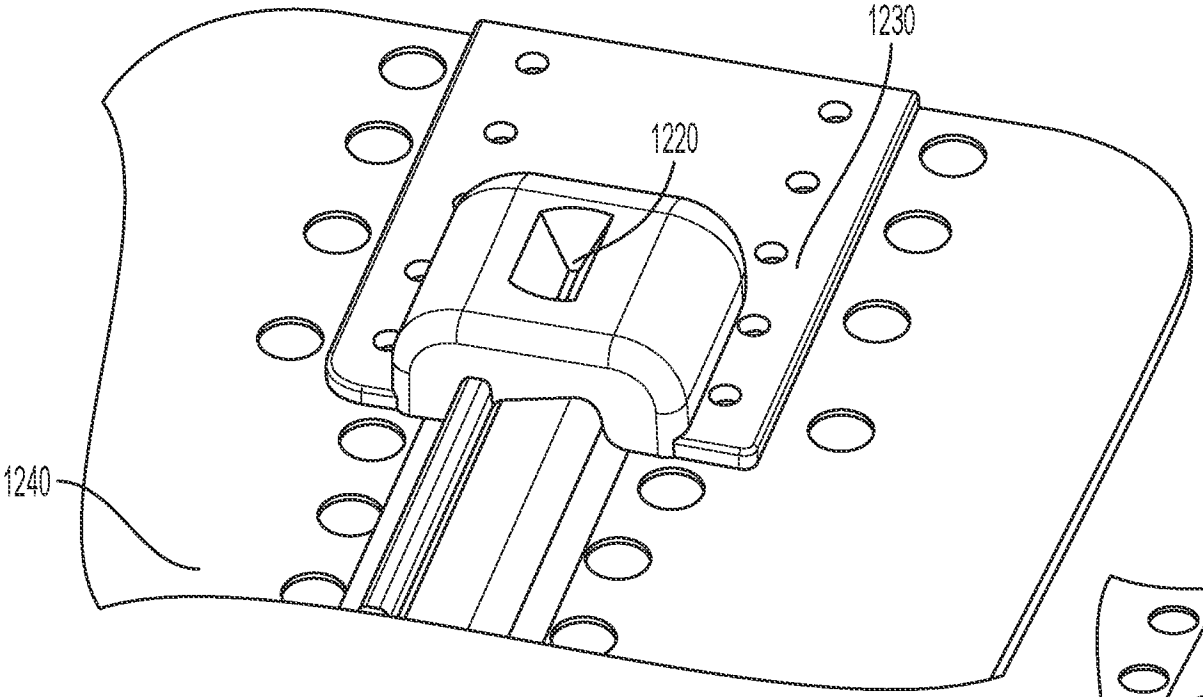

FIGS. 12A and 12B show the end of the zipper opposite the zipper garage. Here, the flange of the zipper 1240 may be heat welded to the flange 1230 of the bottom garage. The bottom connection portion is positioned to completely surround the zipper in a watertight fashion. Cut 1220 may be included to help with flexibility and heat dispersion during the connection or overmolding process. The cross-section of 12B shows how the male portion 1025 and female portion 1030 sit in the bottom connection portion in an engaged fashion, such that they are water tight.

Figure 13:
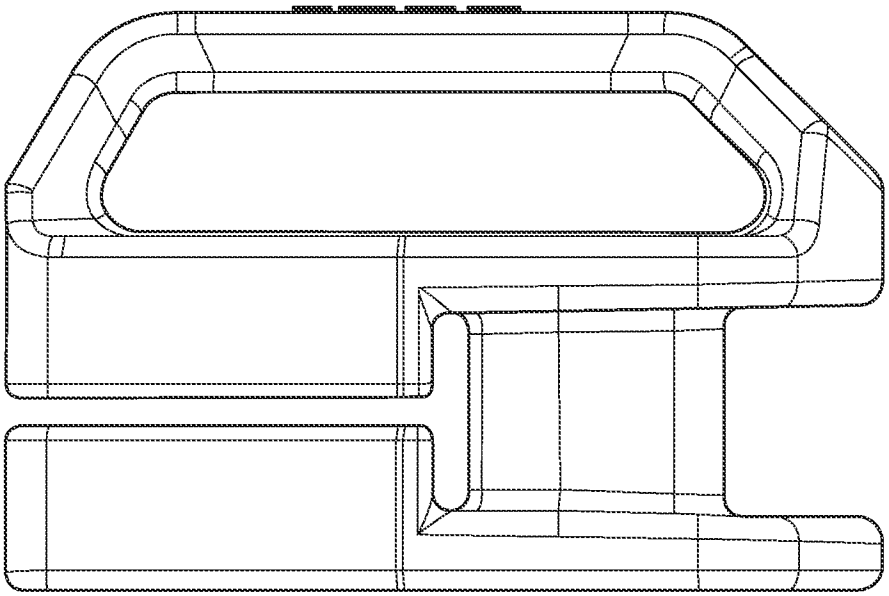
FIGS. 13, 14A, and 14B show embodiments of the slider.
Figures 14A, 14B:
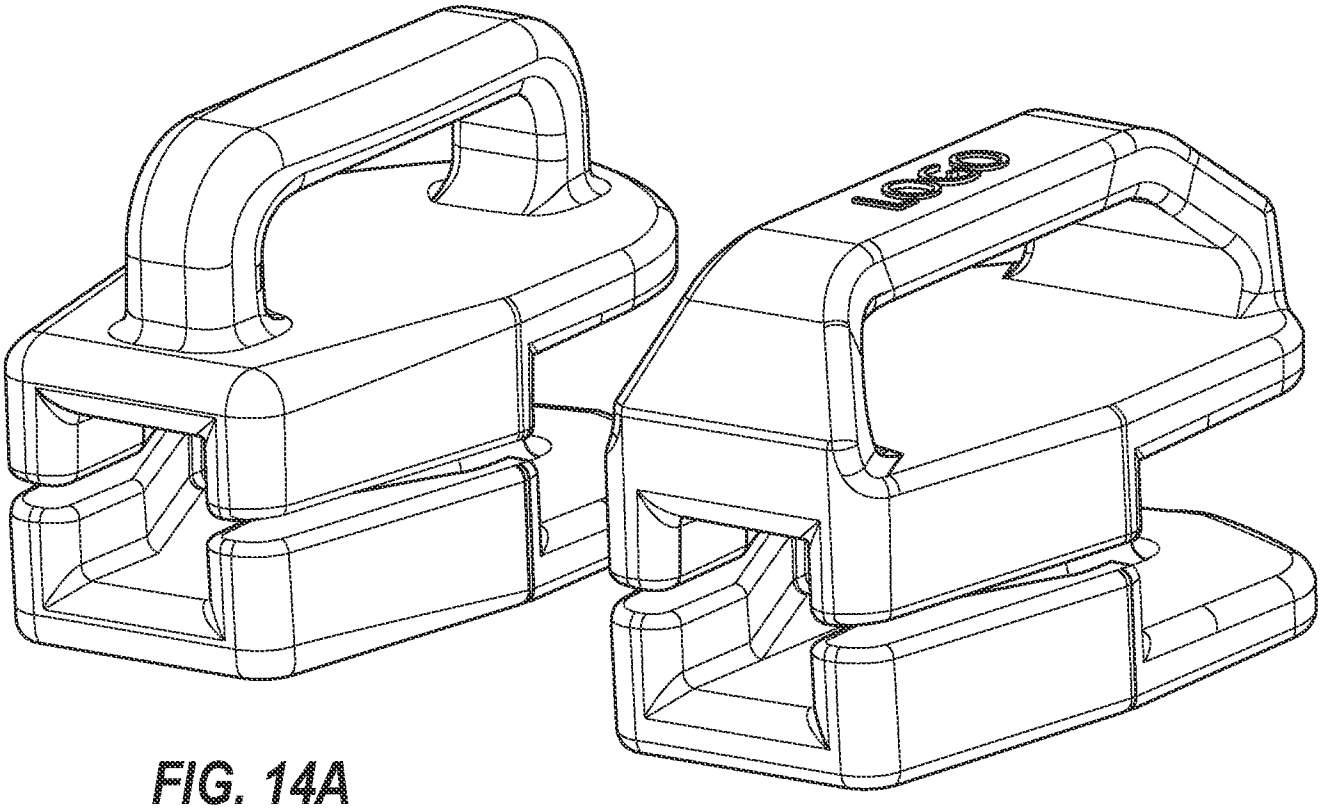

FIGS. 13, 14A, and 14B show embodiments of the slider, which essentially has a center post that fits into the void portion of the slider garage, an open end complementary with the shape of the wide end of the slider garage and a parallel guide that runs along the zipper in operation.

Figure 15:
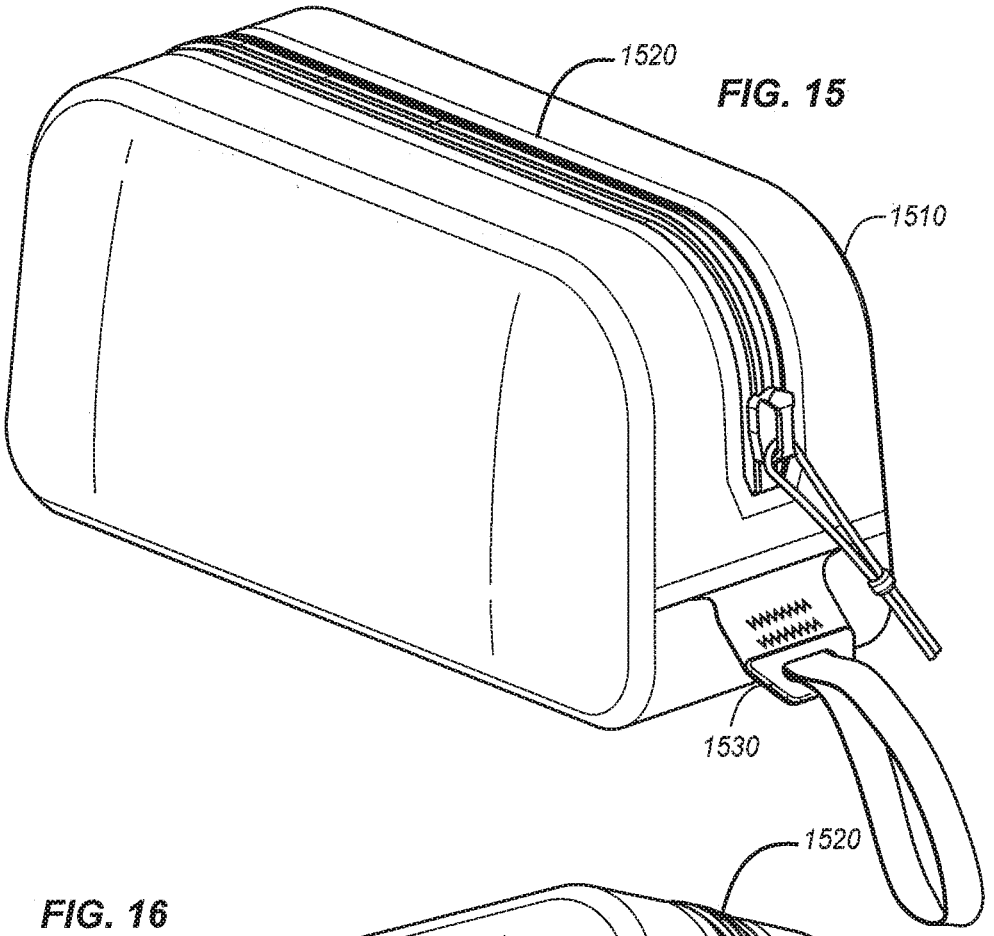
FIGS. 15-18 show two embodiments of waterproof bags utilizing embodiments of zippers including waterproof slider garages.
Figure 16:
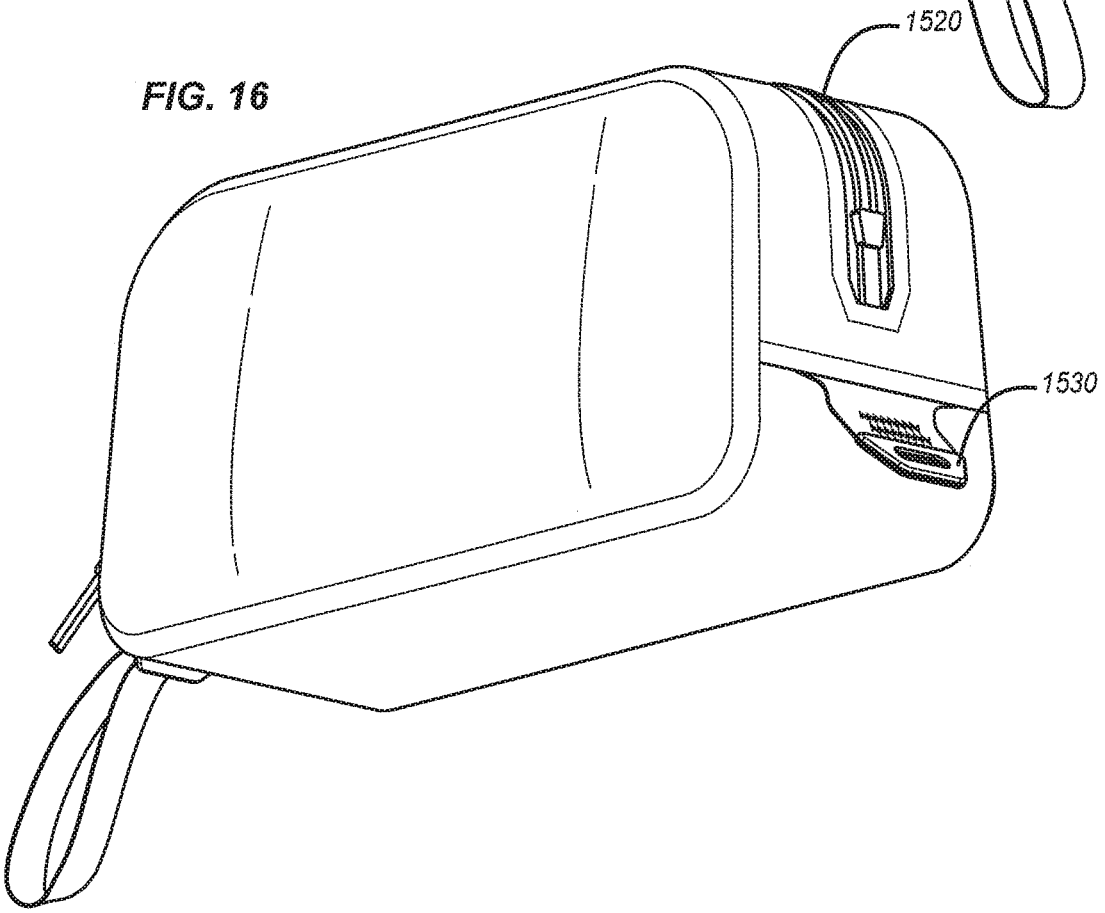
Figure 17:
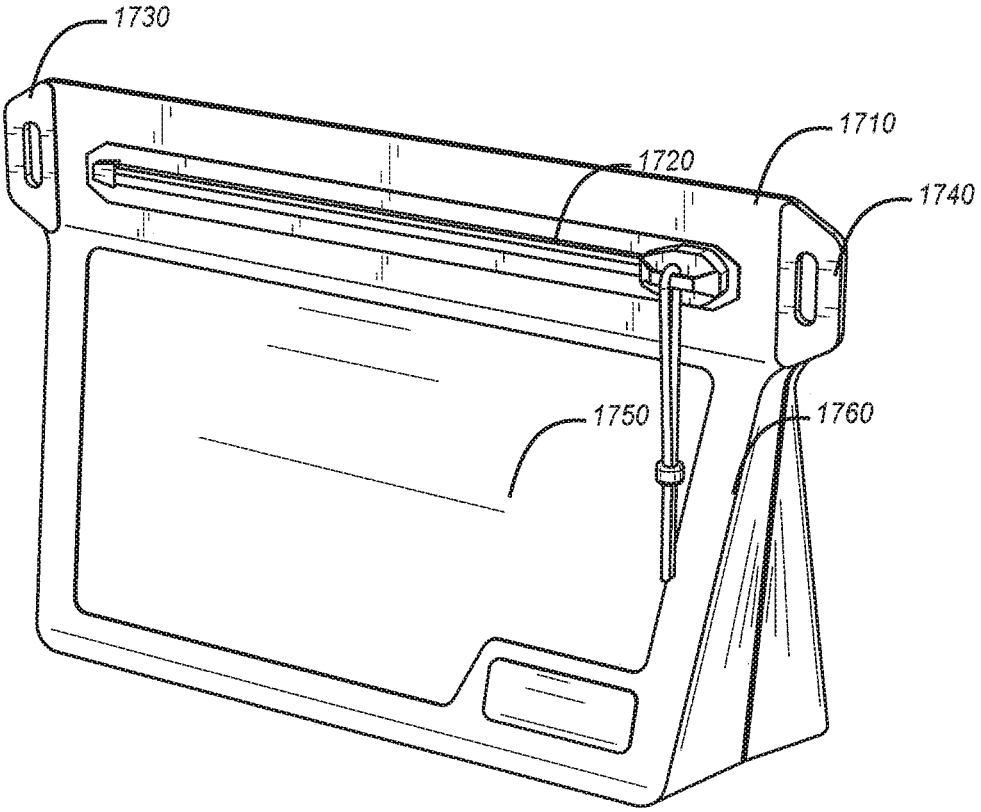
Figure 18:
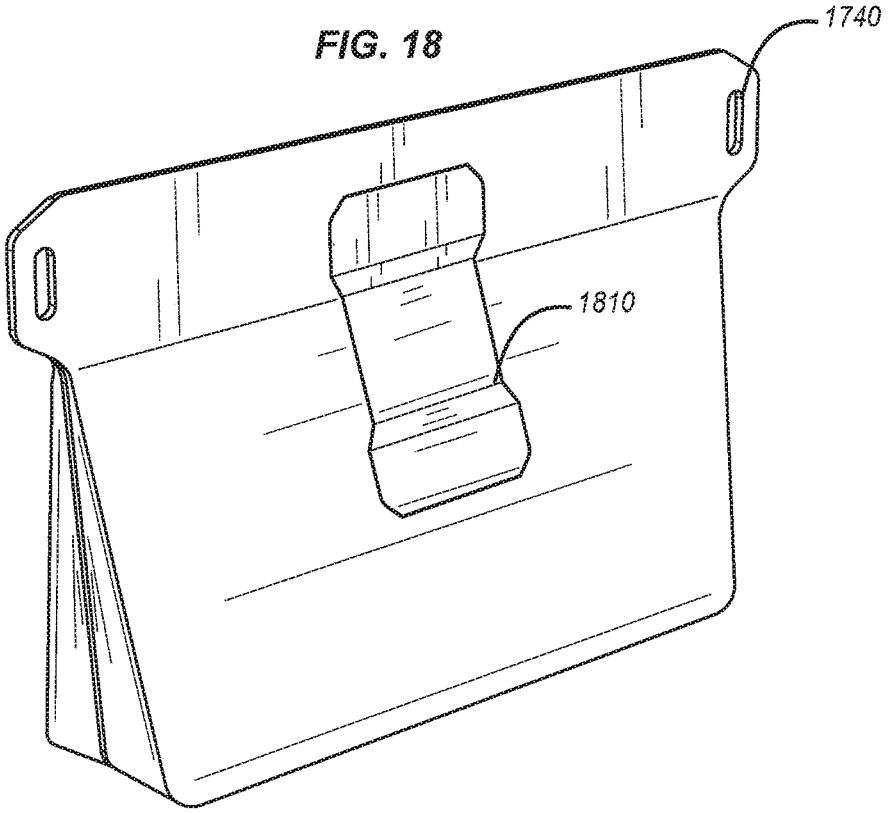

FIGS. 15-18 show two embodiments of waterproof bags utilizing embodiments of zippers including waterproof slider garages. FIGS. 15 and 16 show perspective views of one embodiment of a waterproof bag utilizing an embodiment of zipper including a waterproof slider garage. Bag 1510 includes waterproof zipper 1520 including slider garage. Additionally, bag 1510 includes pulls 1530. Pulls 1530 provide for leverage points to be used in the opening and closing of the zipper and they may accommodate straps or other attachment systems. In many embodiments, bag 1510 is composed of various types of a waterproof material and zipper 1520 is welded (heat welded) in place in bag 1510. FIGS. 17 and 18 show perspective views of one embodiment of a waterproof bag utilizing an embodiment of zipper including a waterproof slider garage. Bag 1710 includes waterproof zipper 1720 including slider garage. Additionally, bag 1710 includes pulls 1730, 1740. Pulls 1730, 1740 provide for leverage points to be used in the opening and closing of the zipper and they may accommodate straps or other attachment systems. In many embodiments, bag 1710 is composed of various types of a waterproof material and zipper 1720 is welded (heat welded) in place in bag 1710. As shown, bag 1710 includes an opaque portion 1760 and a clear portion 1750. This allows the user to see into the bag without releasing it. Additionally, in the rear view of the device, loop 1810 is shown for use in attaching the bag to a belt or other item.

The previous detailed description is of a small number of embodiments for implementing the systems and methods for creating a slider garage and the systems of slider garages and zippers and is not intended to be limiting in scope. The following claims set forth a number of the embodiments of the systems and methods for creating slider garages and the systems of slider garages disclosed with greater particularity.

The invention claimed is:

1. A slider garage, comprising: an overmolded body, the overmolded body oriented on a zipper, the overmolded body including an overmolded male portion and an overmolded female portion, the overmolded male and female portions positioned on an end of the zipper, such that each is on one side of the zipper, the overmolded male portion being shaped such that it fits in the overmolded female portion in a watertight fashion and the overmolded body is molded over a portion of the zipper, wherein the zipper includes a male side and a female side, and the overmolded male portion is positioned on the male side of the zipper and the overmolded female portion is positioned on the female side of the zipper, the overmolded male portion molded over the male side of the zipper such that the overmolded male portion contains a portion of the male side of the zipper, the portion of the male side of the zipper being a part that is shaped to interface with the female side, wherein the overmolded body forms a u-shape and the overmolded male portion and the overmolded female portion are part of the u-shape, wherein the slider garage is configured to engage a slider therein.

2. The slider garage of claim 1, wherein the overmolded male portion and the overmolded female portion are on the interior of the overmolded body where a first and second side of the overmolded body meet when a slider is engaged in the slider garage.

3. The slider garage of claim 1, wherein the zipper interfaces with the overmolded body without interruption.

4. The slider garage of claim 1, wherein the zipper includes a continuous top edge.

5. The slider garage of claim 1, wherein a flange of the zipper is not exposed between the zipper and the overmolded body.

6. The slider garage of claim 1, wherein there is no break in the zipper in the along a length of the zipper.

7. The slider garage of claim 1, wherein there is no break between the zipper along the length of the zipper and the slider garage.

8. A slider garage comprising: an overmolded body, the overmolded body located on an end of a zipper, the zipper having a female side and a male side, the overmolded body providing a waterproof seal when engaged with a slider, wherein the overmolded body is molded over a portion of the zipper such that a portion of the male side is within the overmolded body, the portion of the male side of the zipper being a part that is shaped to interface with the female side, wherein the overmolded body forms a u-shape and an overmolded male portion and an overmolded female portion are part of the u-shape, wherein the slider garage is configured to engage a slider therein.

9. The slider garage of claim 8, wherein the overmolded male portion and the overmolded female portion are on the interior of the overmolded body where a first and second side of the overmolded body meet when a slider is engaged in the slider garage.

10. The slider garage of claim 8, wherein the zipper interfaces with the overmolded body without interruption.

11. The slider garage of claim 8, wherein the zipper includes a continuous top edge.

12. The slider garage of claim 8, wherein a flange of the zipper is not exposed between the zipper and the overmolded body.

13. The slider garage of claim 8, wherein there is no break in the zipper in the along a length of the zipper.

14. The slider garage of claim 8, wherein there is no break between the zipper along the length of the zipper and the slider garage.

15. A slider garage, comprising: an overmolded body, the overmolded body oriented on a zipper, the overmolded body including an overmolded male portion and an overmolded female portion, the overmolded male and female portions positioned on an end of the zipper, such that each is on one side of the zipper, the overmolded male portion being shaped such that it fits in the overmolded female portion in a watertight fashion, wherein the overmolded body is molded over a portion of the zipper, the portion of the zipper being a portion of parts that interconnect to seal along a length of the zipper, wherein the overmolded body forms a u-shape and the overmolded male portion and the overmolded female portion are part of the u-shape, wherein the slider garage is configured to engage a slider therein.

16. The slider garage of claim 15, wherein the overmolded male portion and the overmolded female portion are on the interior of the overmolded body where a first and second side of the overmolded body meet when a slider is engaged in the slider garage.

* * * * *